US008632160B2

(12) United States Patent
Ogawa et al.

(10) Patent No.: US 8,632,160 B2
(45) Date of Patent: Jan. 21, 2014

(54) IMAGE FORMING APPARATUS INCLUDING RECORDING HEAD FOR EJECTING LIQUID DROPLETS

(75) Inventors: Masato Ogawa, Kanagawa (JP); Shinichiro Naruse, Kanagawa (JP); Kenji Shimizu, Kanagawa (JP); Takayuki Niihara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/610,579

(22) Filed: Sep. 11, 2012

(65) Prior Publication Data

US 2013/0070022 A1 Mar. 21, 2013

(30) Foreign Application Priority Data

Sep. 15, 2011 (JP) ..... 2011-202264
Sep. 15, 2011 (JP) ..... 2011-202280

(51) Int. Cl.
*B41J 23/00* (2006.01)
*B41J 25/34* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 4,940,998 | A * | 7/1990 | Asakawa | 347/37 |
| 5,392,063 | A * | 2/1995 | Rhoads | 347/49 |
| 2008/0106575 | A1 * | 5/2008 | Shimizu et al. | 347/49 |
| 2010/0231643 | A1 | 9/2010 | Saiga et al. | |
| 2010/0295897 | A1 | 11/2010 | Naruse et al. | |
| 2011/0134187 | A1 | 6/2011 | Naruse et al. | |
| 2011/0134190 | A1 | 6/2011 | Mase et al. | |
| 2011/0141192 | A1 | 6/2011 | Komuro et al. | |
| 2011/0199410 | A1 | 8/2011 | Mase et al. | |
| 2011/0205299 | A1 | 8/2011 | Naruse et al. | |
| 2011/0216113 | A1 | 9/2011 | Yorimoto et al. | |

FOREIGN PATENT DOCUMENTS

| | | |
|---|---|---|
| JP | 2-1327 | 1/1990 |
| JP | 11-227283 | 8/1999 |
| JP | 11-263005 | 9/1999 |
| JP | 2001-179951 | 7/2001 |
| JP | 2011-37235 | 2/2011 |
| JP | 2011-56840 | 3/2011 |
| JP | 2011-167977 | 9/2011 |

OTHER PUBLICATIONS

U.S. Appl. No. 13/476,164, filed May 21, 2012, Kenji Shimizu, et al.

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

An image forming apparatus includes recording heads, head holders, a carriage, a guide member, a reference member, and a pressing member. The recording heads have nozzles to eject liquid droplets. The holders hold the recording heads. The carriage is reciprocally movable in a main scanning direction and holding the holders. The guide member is disposed along the main scanning direction to guide the carriage along the main scanning direction. The reference member is disposed parallel to the guide member in the carriage to hold the holders. The pressing member presses at least one of the holders toward at least another of the holders. The holders have reference faces to contact each other in the main scanning direction to determine relative positions of the holders. With the recording heads positioned based on the reference faces of the holders, the recording heads are held by the holders.

12 Claims, 9 Drawing Sheets

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application Nos. 2011-202280, filed on Sep. 15, 2011, and 2011-202264, filed on Sep. 15, 2011 in the Japan Patent Office, the entire disclosure of each of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

When image formation is performed with such a liquid-ejection type image forming apparatus, the landing accuracy of liquid droplets ejected from nozzles significantly affects image quality. As a low level of landing accuracy reduces image quality, it is preferably to position the recording head at high accuracy.

For this reason, when a plurality of recording heads are mounted on a plurality of head holders, the relative positions of the recording heads mounted on the head holders need be determined at high accuracy.

Hence, for example, JP-02-001327 proposes an image forming apparatus that moves carriages mounting separatable head holders along guide rods parallel to each other. The head holders have a pressing member and a locking mechanism to position the head holders in the main scanning direction when the head holder are connected.

However, for the configuration proposed in JP-02-001327, since a connecting mechanism is disposed at the head holders, accumulated errors may occur. In addition, using the lock mechanism causes a complex configuration and increased cost.

In addition, if ejection failure occurs in the recording head, it is preferable that the recording head can be easily replaced at the site at which the apparatus is used. Even in such a case, a high degree of positioning accuracy of the recording head need be reproduced after replacement.

To enhance the positioning accuracy in replacing the recording head, for example, JP-2011-037235-A1 proposes an image forming apparatus including a head holder mounting liquid ejection heads and a carriage removably mounting the head holder. The head holder has positioning portions to contact positioning references in both the carriage scanning direction and the sheet conveyance direction, and the positioning portions serve as positioning references relative to the head holder of liquid ejection head.

However, for the image forming apparatus disclosed in JP-2011-037235-A1, the carriage of the head holder is positioned by positioning faces and pins, thus resulting in a complex configuration. In particular, in a case where the image forming apparatus has multiple head holders, the positioning portions need be provided for the respective head holders. Such a configuration makes it difficult to position the head holders relative to each other at high accuracy and replace the recording head in a simple manner.

BRIEF SUMMARY

In an aspect of this disclosure, there is provided an image forming apparatus including a plurality of recording heads, a plurality of head holders, a carriage, a guide member, a reference member, and a pressing member. The plurality of recording heads has a plurality of nozzles to eject liquid droplets. The plurality of head holders holds the plurality of recording heads. The carriage is reciprocally movable in a main scanning direction and holding the plurality of head holders. The guide member is disposed along the main scanning direction to guide the carriage along the main scanning direction. The reference member is disposed parallel to the guide member in the carriage to hold the plurality of head holders. The pressing member presses at least one of the plurality of head holders toward at least another of the plurality of head holders. The plurality of head holders has reference faces to contact each other in the main scanning direction to determine relative positions of the plurality of head holders. With the plurality of recording heads positioned based on the reference faces of the plurality of head holders, the plurality of recording heads is held by the plurality of head holders.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION OF EXEMPLARY EMBODIMENTS

Figure 1:
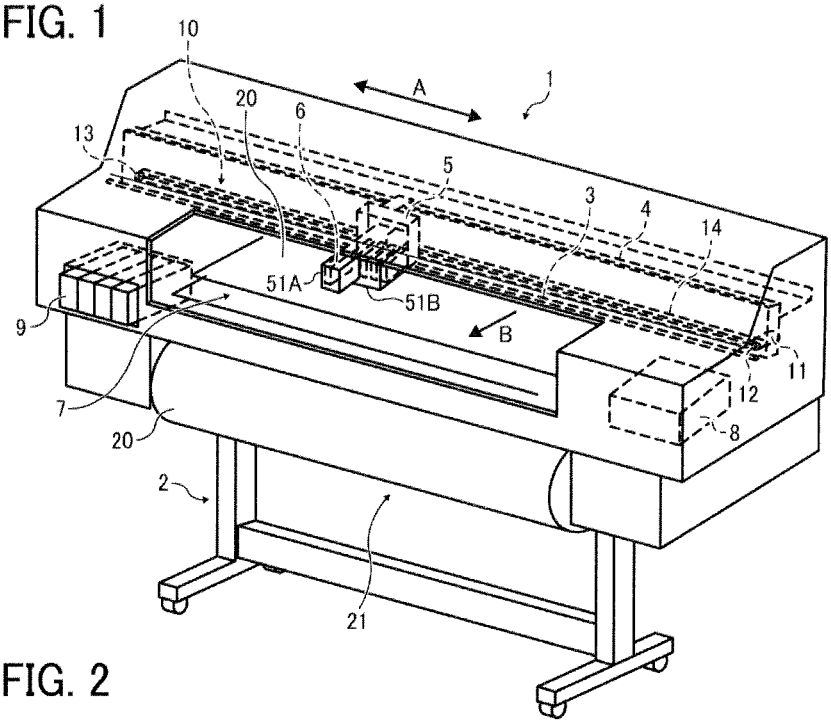
FIG. 1 is an external perspective view of an image forming apparatus according to an exemplary embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

In this disclosure, the term "sheet" used herein is not limited to a sheet of paper but be, e.g., an OHP (overhead projector) sheet, a cloth sheet, a grass sheet, a substrate, or anything on which droplets of ink or other liquid can be adhered. In other words, the term "sheet" is used as a generic term including a recording medium, a recorded medium, a recording sheet, or a recording sheet of paper. The terms "image formation" are used as a synonym for "image recording" and "image printing". The term "image forming apparatus" refers to an apparatus that ejects ink or any other liquid onto a medium to form images on the medium. The medium is made of, for example, paper, string, fiber, cloth, leather, metal, plastic, glass, timber, and ceramic. The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "ink" as used herein is not limited to "ink" in a narrow sense unless specifically distinguished and includes any types of liquid useable for image formation, such as recording liquid, fixing solution, DNA sample, resist, pattern material, and resin.

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Referring now to the drawings, wherein like reference numerals designate identical or corresponding parts throughout the several views, exemplary embodiments of the present disclosure are described below, First, an image forming apparatus according to an exemplary embodiment of this disclosure is described with reference to FIGS. 1 and 2.

Figure 2:
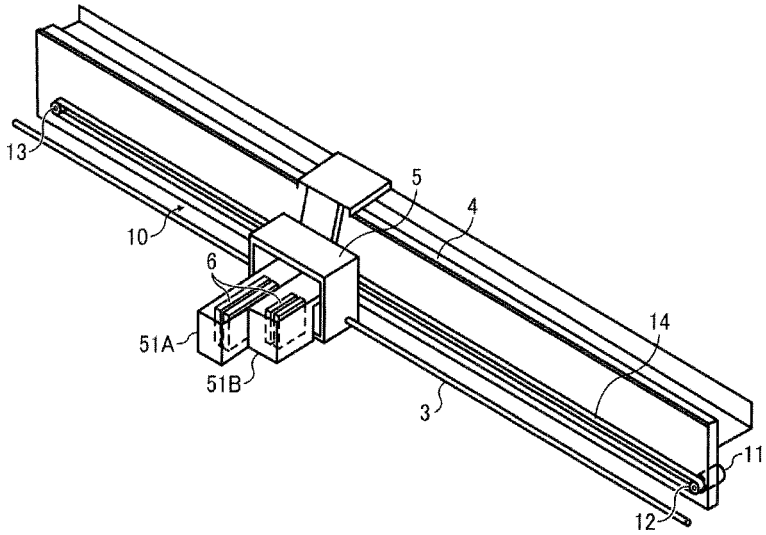
FIG. 2 is a perspective view of a carriage scanning unit of the image forming apparatus of FIG. 1.

FIG. 1 is a perspective view of the image forming apparatus. FIG. 2 is a perspective view of a carriage scanning unit of the image forming apparatus.

In FIG. 1, the image forming apparatus is a serial-type inkjet recording apparatus and has an apparatus body 1 and a support stand 2 to support the apparatus body 1.

The apparatus body 1 includes a guide rod 3 and a guide stay 4 serving as guide members extending between side plates. A carriage 5 is supported by the guide rod 3 and the guide stay 4 so as to be slidable along a direction indicated by an arrow A in FIG. 1.

The carriage 5 mounts recording heads 6 serving as liquid ejection heads for ejecting ink droplets of, for example, black (K), yellow (Y), magenta (M), and cyan (C). The recording heads 6 are integrally provided with head tanks that supply inks to the recording heads.

A main scanning unit 10 for moving the carriage 5 for scanning includes a driving motor 11 disposed at a first end in a main scanning direction, a driving pulley 12 rotated by the driving motor 11, a driven pulley 13 disposed at a second end opposite the first end in the main scanning direction, and a timing belt 14 serving as a drawing member wound around the driving pulley 12 and the driven pulley 13. A tension spring urges the driven pulley 13 outward (in a direction to move away from the driving pulley 12) to apply tension to the timing belt.

In a recording area of a main scanning region of the carriage 5, an aspiration conveyance unit 7 intermittently conveys a sheet 20 in a direction (sub-scanning direction or sheet conveyance direction) indicated by an arrow B in FIG. 1.

At one end of the main scanning region is disposed a maintenance unit (maintenance-and-recovery unit) 8 to maintain and recover good conditions of the recording heads 6. Outside a movement range of the carriage 5 in the main scanning direction or at the second end side of the main scanning region of the carriage 5, main cartridges 9 are removably mounted to the apparatus body 1 to store the respective color inks to be supplied to sub tanks (head tanks) of the recording heads 6.

In FIG. 1, a roll sheet (hereinafter, "sheet") 20 is set on a sheet feeder 21. It is to be noted that a roll sheet of a different width can be set on the sheet feeder 21. The sheet 20 fed from the sheet feeder 21 is conveyed with a conveyance device from a rear side to a front side of the apparatus to arrive at the recording area. While moving the carriage 5 in the main scanning direction and intermittently conveying the sheet 20 with the aspiration conveyance unit 7, the inkjet recording apparatus drives the recording heads 6 in accordance with image information to eject droplets from the recording heads 6, thus forming a desired image on the sheet 20. After image formation, the sheet 20 is cut at a predetermined length and discharged to a discharge tray at the front side of the apparatus body 1.

Next, a first exemplary embodiment of this disclosure is described with reference to FIGS. 3 and 4.

Figure 3:
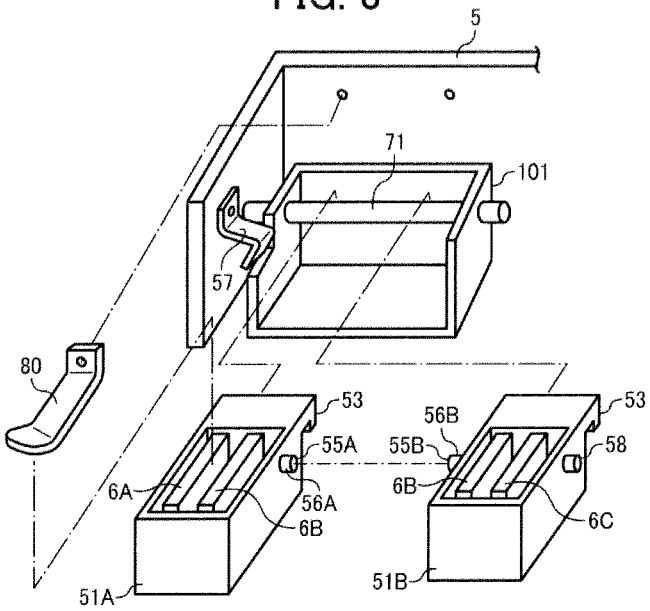
FIG. 3 is an exploded perspective view of a carriage section in a first exemplary embodiment of this disclosure.

FIG. 3 is an exploded perspective view of a carnage section in the first exemplary embodiment. FIG. 4 is a plan view of the carriage section.

The carriage 5 mounts a head holder 51A for black and a head holder 51B for other colors.

The head holder 51A mounts two recording heads 6A and 6B to eject ink droplets of black ink. The head holder 51B mounts two recording heads 6C and 6D to eject ink droplets of yellow, magenta, and yellow. Each of the recording heads 6C and 6D has two nozzle rows, and three of the four nozzle rows of the recording heads 6C and 6D are allocated to yellow, magenta, and cyan. Alternatively, each of the head holders 51A and 51B may hold a single recording head 6.

In the carriage 5, a reference shaft member 71 serving as a reference member is disposed parallel to the guide rod 3. An intermediate member 101 is held by the reference shaft member 71, and the head holders 51A and 51B (hereinafter, referred to as "head holders 51" unless distinguished) are held by the reference shaft member 71 within the intermediate member 101.

Each of the head holders 51A and 51B has a hook portion 53 removably hooked on the reference shaft member 71. By hooking the hook portion 53 on the reference shaft member 71, the head holders 51A and 51B are held by the carriage 5. It is to be noted that the reference shaft member 71 may be cylindrical or polygonal.

As described above, arranging the reference shaft member 71 in parallel to the guide member 3 of the carriage 5 enhances the positional accuracy with respect to the inclination in the sub-scanning direction, the height direction, the tilt direction, and the main scanning direction.

Next, a positioning structure of the head holders in this exemplary embodiment is described below.

The head holders 51A and 51B have protrusions 56A and 56B, respectively, at side faces opposing each other in the main scanning direction. The protrusions 56A and 56B have reference faces 55A and 55B, respectively, to contact each other to determine relative positions of the head holders 51A and 51B.

The recording heads 6A and 6B are positioned by using the reference face 55A of the head holder 51A as a reference point and held by the head holder 51A. The recording heads 6C and 6D are positioned by using the reference face 55B of the head holder 51B as a reference point and held by the head holder 51B.

At an inner side face of the carriage 5 in the main scanning direction is disposed a pressing member 57 formed of an elastic member, such as a leaf spring, to press, toward the head holder 51B, a side face opposite the side face having the reference face 55A (the protrusion 56A) of the head holder 51A.

At a side face opposite the side face having the reference face 55B (the protrusion 56B) of the head holder 51B is disposed a convex portion 58 serving as a positioning portion to position the head holder 518 relative to the intermediate member 101.

The carriage 5 has holder pressing members 80 serves as a holder pressing unit to press the head holders 51A and 51B from the upper side of the head holders 51A and 51B. In FIG. 3, one of the holder pressing members 80 is illustrated for simplicity.

Thus, the reference face 55A of the head holder 51A pressed by the pressing member 57 in the main scanning direction contacts the reference face 55B of the head holder 51B. In other words, by contacting the reference faces 55A and 55B each other, the relative positions of the head holders 51A and 51B are determined at high accuracy. As described above, the distance between the head holder 51B and the intermediate member 101 is determined by the convex portion 58.

With the recording heads 6A and 6B positioned based on the reference face 55A of the head holder 51A, the recording heads 6A and 6B are held in the head holder 51A. With the recording heads 6C and 6D positioned based on the reference face 55B of the head holder 51B, the recording heads 6C and 6D are held in the head holder 51B.

Figure 4:
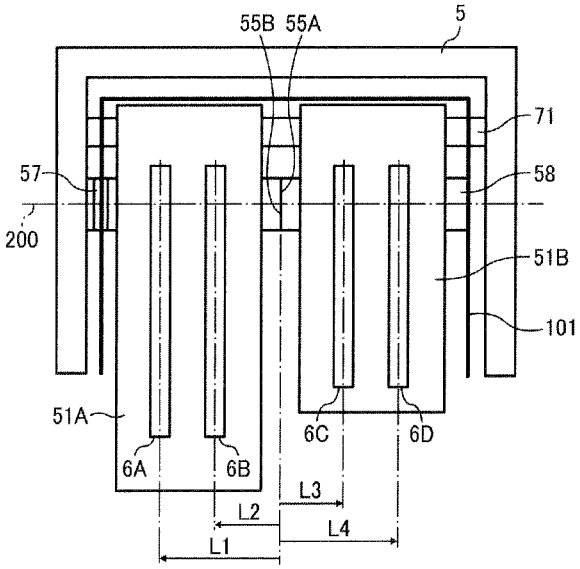
FIG. 4 is a plan view of the carriage section of FIG. 3.

In other words, as illustrated in FIG. 4, the recording head 6A is positioned and held at a distance L1 from the reference face 55A of the head holder 51A, and the recording head 6B is positioned and held at a distance L2 from the reference face 55A of the head holder 51A. The recording head 6C is positioned and held at a distance L3 from the reference face 55B of the head holder 51B, and the recording head 6D is positioned and held at a distance L4 from the reference face 55B of the head holder 51B.

Thus, the relative positions between the recording heads 6A and 6B and the recording heads 6C and 6D are determined at high accuracy.

As described above, in this exemplary embodiment, the reference faces of the head holders contacting each other act as the reference positions and a connecting member does not intermediate between the reference faces. Such a configuration can determine the relative positions of the respective recording heads of the multiple head holders at high accuracy with a simple structure.

In addition, since the pressing member 57 and the reference faces 55A and 55B are arranged on a common straight line 200, the pressing member 57 can uniformly transmit the pressing force to the head holders 51A and 51B, thus minimizing occurrence of the rotational moment of the head holders 51A and 51B. Thus, the reference faces 55A and 55B can contact each other at high accuracy, and the relative positions between the head holders can be determined at high accuracy.

Figure 5A:
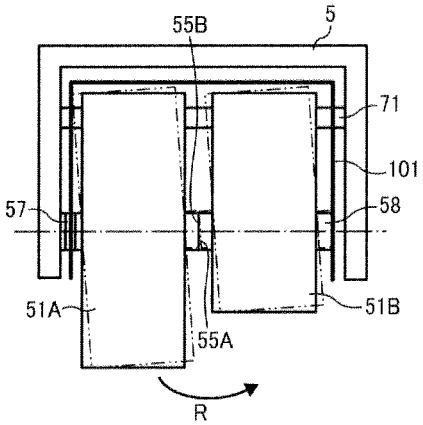
FIG. 5A is a plan view of a carriage section according to a comparative example.
Figure 5B:
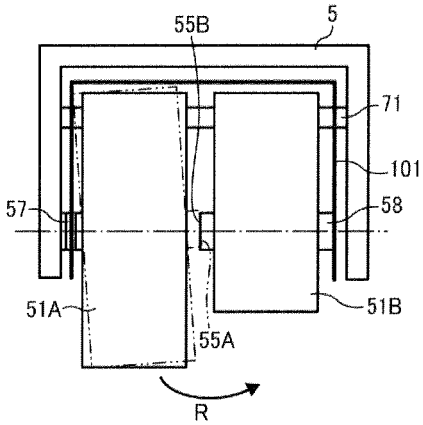
FIG. 5B is a plan view of a carriage section according to another comparative example.

Here, if the reference shaft member 71 and a pressing point of the pressing member 57 are too far away from each other, as illustrated in FIGS. 5A and 5B, the pressing force of the pressing member 57 would cause a moment force to act on the head holders 51A and 51B. As a result, the head holders 51A and 51B may rotationally shift in a direction indicated by an arrow R relative to the reference shaft member 71, thus hampering highly accurate positioning of the head holders 51A and 51B.

Hence, the pressing point of the pressing member 57 is preferably located near the reference shaft member 71.

As described above, in this first exemplary embodiment, the head holders 51A and 51B are pressed by the pressing member 57 in the main scanning direction to determine the positions of the head holders 51A and 51B in the main scanning direction. In addition, the head holders 51A and 51B are pressed downward and positioned by the holder pressing members 80.

Next, a second exemplary embodiment of this disclosure is described with reference to FIGS. 6 and 7.

Figure 6:
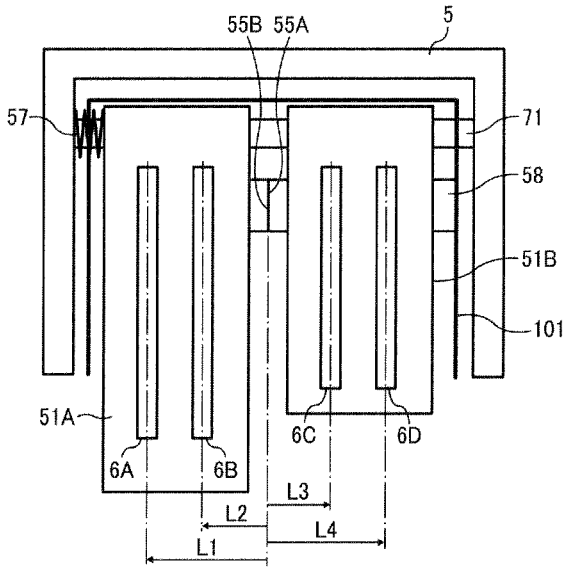
FIG. 6 is a schematic plan view of a carriage section in a second exemplary embodiment of this disclosure.
Figure 7:
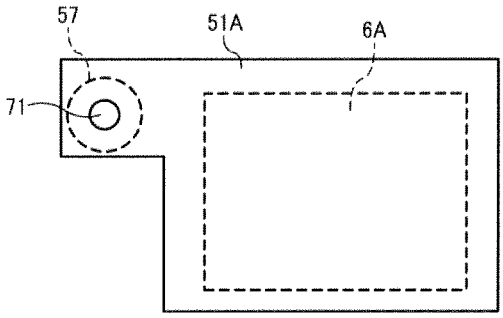
FIG. 7 is a side view of the carriage section seen from a left side of FIG. 6.

FIG. 6 is a schematic plan view of a carriage section in the second exemplary embodiment. FIG. 7 is a side view of the carriage section seen from the left side of FIG. 6.

In this second exemplary embodiment, a pressing member 57 formed of, e.g., a spring, is disposed around a reference shaft member 71.

Thus, the pressing member 57 is arranged on the same straight line as the reference shaft member 71 to press the head holders 51. Such a configuration can prevent the pressing force of the pressing member 57 from causing rotational moment of the head holder 51, thus preventing the head holders 51 from rotationally shifting relative to the reference shaft member 71. Such a configuration can determine the relative positions between the head holders at high accuracy with a simple structure.

Next, a third exemplary embodiment of the present disclosure is described with reference to FIGS. 8 to 10.

Figure 8:
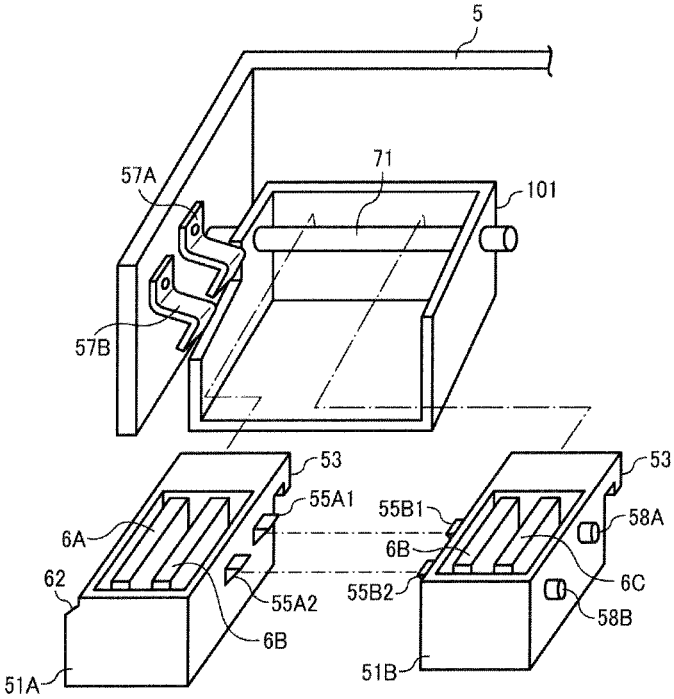
FIG. 8 is a schematic exploded perspective view of a carriage section in a third exemplary embodiment of this disclosure.
Figure 9:
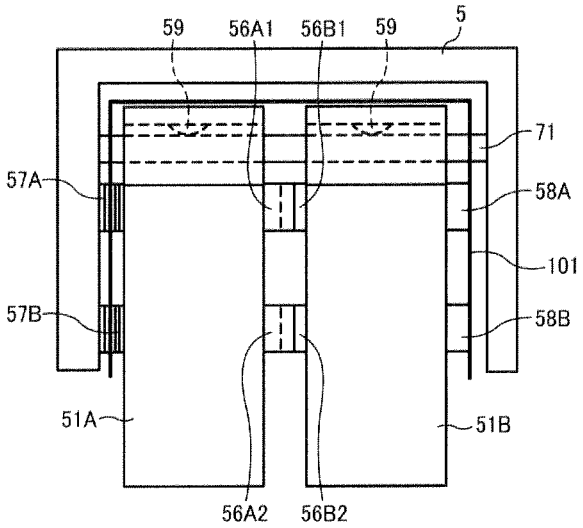
FIG. 9 is a schematic plan view of the carriage section of FIG. 8.

FIG. 8 is a schematic exploded perspective view of a carriage section in the third exemplary embodiment, FIG. 9 is a schematic plan view of the carriage section. FIG. 10 is a schematic front view of a head holder section in the third exemplary embodiment.

In this exemplary embodiment, as illustrated in FIG. 8, reference faces 55A, reference faces 55B, and pressing members 57 similar to those of the first exemplary embodiment are disposed at two points in the sub-scanning direction on a head holder 51A, a head holder 51B, and a carriage 5, respectively. In FIG. 8, elements of each pair of the reference faces 55A, the reference faces 55B, and the pressing members 57 have the same position in the height direction. However, it is to be noted that the elements of each pair may be disposed at different positions in the height direction.

In other words, the head holder 51A has protrusions 56A1 and 56A2. The protrusions 56A1 and 56A2 have two reference faces 55A1 and 55A2 disposed at two points in the sub-scanning direction. The head holder 51B has protrusions 56B1 and 56B2. The protrusions 56B1 and 56B2 have two reference faces 55B1 and 55B2 at two points in the sub-scanning direction. The reference face 55A1 contacts the reference face 55B1, and the reference face 55A2 contacts the reference face 55B2. As a result, the relative positions of the head holders 51A and 51B are determined.

In addition, a pressing member 57A and the reference faces 55A1 and 55B1 are disposed on a common straight line, and a pressing member 57B and the reference faces 55A2 and 55B2 are arranged on another common straight line. The pressing member 57A and 57B press the head holder 51A toward the head holder 51B in the main scanning direction.

The head holders 51A and 51B have contact portions 59A and 59B, respectively, to contact the reference shaft member 71 at a single point. Each of the contact portions 59A and 59B contacts the reference shaft member 71 at a plane passing the center of axis of the reference shaft member 71 and parallel to the sub-scanning direction.

As described above, by contacting each of the head holders 51A and 51B with the reference shaft member 71 at a single point, not only the reference faces 55A1 and 55B1 at upstream sides but also the reference faces 55A2 and 55B2 at downstream sides of the head holders 51A and 51B, respectively, in the sub-scanning direction can contact each other.

Such a configuration can minimize positional shift of the head holders 51A and 51B which might be caused by vibration of the head holders 51A and 51B during movement of the carriage 5.

Figure 10:
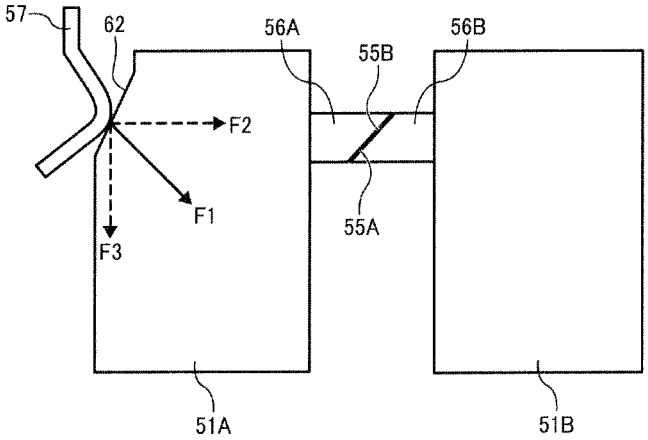
FIG. 10 is a schematic front view of a head holder section in the third exemplary embodiment.

In addition, in this exemplary embodiment, as illustrated in FIG. 10, the head holder 51A has a slanted face 62 slanted obliquely upward in a direction perpendicular to the main scanning direction to receive the pressing force of the pressing members 57 (57A and 57B). The reference faces 55A1, 55A2, 55B1, and 55B2 of the head holders 51A and 51B are slanted in the same direction as the slanted face 62.

As a result, a pressing force F1 of the pressing member 57 creates a component force F2 to press the head holder 51A in the main scanning direction and a component force F3 to push the head holder 51A downward. The head holder 51A is pushed downward by the component force F3, and a pushing force acts on the head holder 51B via the reference faces 55A and 55B in a direction to push the head holder 51B downward.

Thus, the pressing force of the pressing member 57 in the main scanning direction can be applied downward (a direction in which the head holder 51 is pressed against the reference shaft member 71) in a face of each of the head holders perpendicular to the main scanning direction. Such a configuration can obviate the holder pressing members to push the head holder downward, thus resulting in a simple configuration.

Next, a fourth exemplary embodiment of this disclosure is described with reference to FIGS. 11 and 12.

Figure 11:
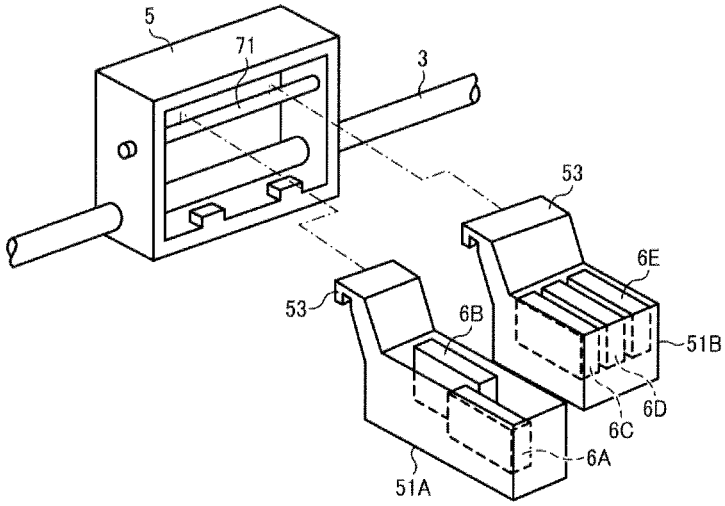
FIG. 11 is a schematic perspective view of a carriage section in a fourth exemplary embodiment in a state before head holders are mounted on a carriage.
Figure 12:
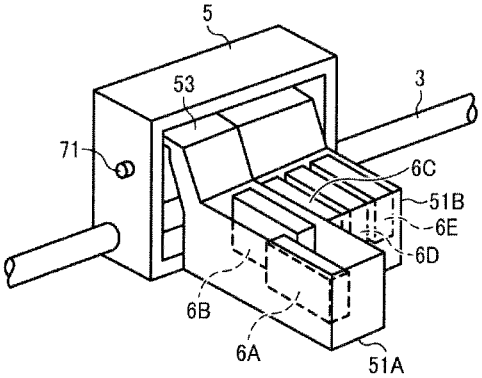
FIG. 12 is a perspective view of the carriage section in the fourth exemplary embodiment with the head holders mounted on the carriage.

FIG. 11 is a schematic perspective view of a carriage section in the fourth exemplary embodiment in a state before head holders are mounted on a carriage. FIG. 12 is a perspective view of the carriage section with the head holders mounted on the carriage.

The carriage 5 mounts a head holder 51A for black and a head holder 51B for other colors.

The head holder 51A holds two recording heads 6A and 6B for ejecting black ink droplets. On the head holder 51A, the recording heads 6A and 6B are offset from each other in the sub-scanning direction. The head holder 51B holds three recording heads 6C, 6D, and 6E for ejecting ink droplets of, e.g., yellow, magenta, and cyan. The recording heads 6C, 6D, and 6E are arranged so as to have the same position as the recording head 6B in the sub-scanning direction. As described above, the recording heads 6A, 6B, 6C, 6D, and 6D are referred to as "recording heads 6" unless distinguished. Alternatively, each of the head holders 51A and 51B may hold a single recording head 6.

In the carriage 5, a reference shaft member 71 serving as a reference member is disposed parallel to the guide rod 3. Each of the head holders 51A and 51B (hereinafter, referred to as "head holders 51" unless distinguished) has a hook portion 53 removably hooked on the reference shaft member 71. The head holders 51A and 51B are held by the carriage 5 with the hook portion 53 hooked on the reference shaft member 71. It is to be noted that the reference shaft member 71 may be cylindrical or polygonal.

As described above, arranging the reference shaft member 71 in parallel to the guide member 3 of the carriage 5 enhances the positional accuracy with respect to the inclination in the sub-scanning direction, the height direction, the tilt direction, and the main scanning direction.

In this exemplary embodiment, in replacing, e.g., the recording heads 6A and 6B of the head holder 51A, the head holder 51A is removed from the reference shaft member 71. After replacing the recording heads 6A and 6B, the head holder 51A is hooked on and held by the reference shaft member 71.

Such a configuration can reproduce the positional accuracy of the recording heads 6 of the head holder 51 (in the above-described example, the head holder 51A) after replacement while obtaining a high degree of positional accuracy of the recording heads 6 of the other head holder 51 (in the above-described example, the head holder 51B) not replaced.

As described above, the image forming apparatus according to the fourth exemplary embodiment has one or more recording heads having a plurality of nozzles to eject liquid droplets, one or more head holders to hold the one or more recording heads, a carriage to hold the one or more head holders, a guide member arranged along a main scanning direction to guide the carriage in the main scanning direction, and a reference member disposed parallel to the guide member in the carriage. The head holders are removably hooked on and held by the reference member. Such a configuration allows the recording heads to be positioned at high accuracy, thus facilitating replacement of the recording heads.

Next, a structure for pressing the head holders in the fourth exemplary embodiment is described with reference to FIGS. 13 and 14.

Figure 13:
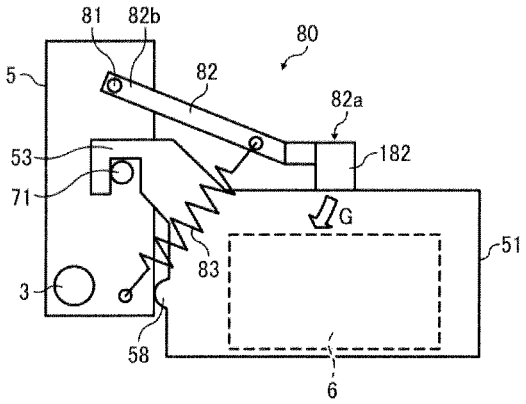
FIG. 13 is a side view of the carriage section and a structure for pressing the head holds in the fourth exemplary embodiment.

FIG. 13 is a side view of the carriage section and the pressing structure in the fourth exemplary embodiment. FIG. 14 is a schematic perspective view of the carriage section with a cover member serving as a holder pressing member mounted on the carriage.

As illustrated in FIG. 13, each of the head holders 51A and 51B has at least one convex portion 58 serving as a contact portion to contact the carriage 5. In FIGS. 13 and 14, each of the head holders 51A and 51B has a single hook portion 53 in the main scanning direction. It is to be noted that each head holder may have a plurality of hook portions, and for example, hooked portions 53 may be disposed at both ends of each head holder in the main scanning direction.

A holder pressing unit 80 serving as a pressing unit is arranged to press the head holders 51 in such a direction that the head holders 51 rotate around the reference shaft member 71 toward the carriage 5. In other words, the holder pressing unit 80 presses the head holders 51A and 51B from the upper side of the head holders 51A and 51B.

The holder pressing unit 80 has a cover member 82 serves as a holder pressing member to press the head holders 51. The cover member 82 has a rear end portion 82*b* rotatably supported by the carriage 5 via a shaft 81. The cover member 82 is, for example, a substantially-flat plate member as illustrated in FIG. 14.

Figure 14:
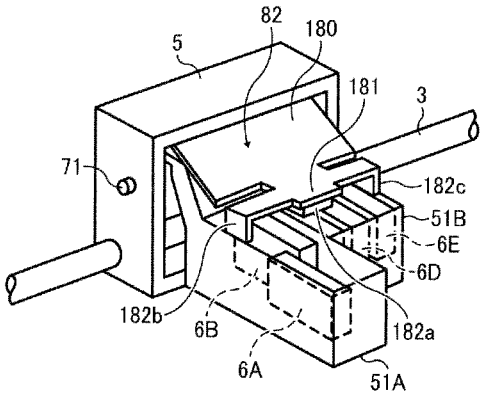
FIG. 14 is a schematic perspective view of the carriage section with a cover member serving as a holder pressing member mounted on the carriage.

In FIG. 14, the single cover member 82 covers both the head holders 51A and 51B. It is to be noted that two cover members may be provided so as to press and cover the respective head holders 51A and 51B.

At the front end side 82*a*, the cover member 82 has pressing portions 182 (182*a* to 182*c* described below) to contact the head holders 51 from above. An elastic member 83, such as an extension coil spring, is disposed between the cover member 82 and the carriage 5. By the elastic tensile force of the elastic member 83, the pressing portions 182 of the cover member 82 presses (pushes) the head holders 51 in a direction indicated by an arrow G in FIG. 13.

As a result, the head holders 51 are urged by the cover member 82 so as to rotate in a clockwise direction indicated by the arrow G in FIG. 13 around the reference shaft member 71. Thus, since the head holders 51 are pressed against the reference shaft member 71 and the carriage 5, the head holders 51A and 51B are positioned. In other words, the head holders 51 can be simply positioned by hooking the head holders 51 on the reference shaft member 71 and closing the cover member 82 (i.e., covering an area above the head holder 51 with the cover member 82).

As a result, even in a case where recording heads are replaced at a user's site, the recording heads can be positioned at high accuracy, thus facilitating replacement of the recording heads.

Figure 16:
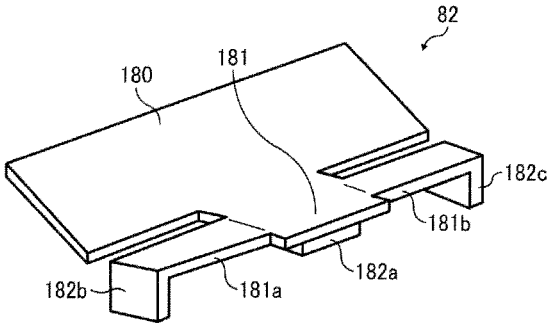
FIG. 16 is a perspective view of the cover member.
Figure 17:
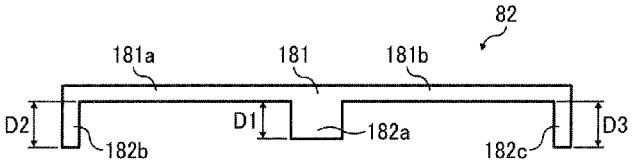
FIG. 17 is a front view of the cover member in a state in which the head holders are not pressed by the cover member.

Next, the cover member 82 is further described with reference to FIGS. 15 to 17.

Figure 15:
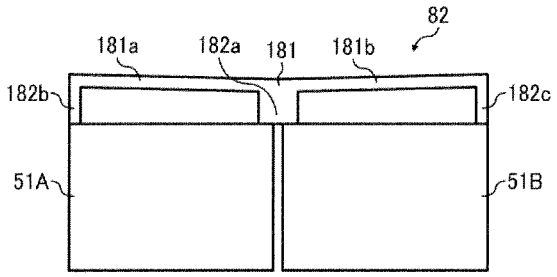
FIG. 15 is a front view of the head holders and the cover member n a state in which the head holders are pressed by the cover member.

FIG. 15 is a front view of the head holders and the cover member in a state in which the head holders are pressed by the cover member. FIG. 16 is a perspective view of the cover member. FIG. 17 is a front view of the cover member in a state in which the head holders are not pressed by the cover member.

The cover member 82 has a cover part 180 and a pressing part 181. The cover part 180 covers an area above and opposes the head holders 51A and 51B, and the pressing part 181 has the pressing portions 182*a* to 182*c*. In the pressing part 181, the three pressing portions 182*a* to 182*c* are arranged along a moving direction of the carriage 5.

The pressing portion 182*a* presses end portions of the head holders 51A and 51B adjacent to each other in the main scanning direction. The pressing portions 182*b* and 182*c* press respective end portions of the head holders 51A and 51B away from each other in the main scanning direction.

The pressing part 181 has arm portions 181*a* and 181*b* extending from a middle portion having the pressing portion 182*a* toward both ends in the moving direction of the carriage 5. The arm portions 181*a* and 181*b* are made of bendable material, and the pressing portions 182*b* and 182*c* are formed at respective outer ends of the arm portions 181*a* and 181*b*.

In a state in which the pressing portions 182*a* to 182*c* do not press the head holders 51A and 51B, the pressing portions 182*b* and 182*c* at both ends more protrude toward the head holders than the pressing portion 182*a* at the middle portion. In other words, as illustrated in FIG. 17, distances D2 and D3 from the top to the bottom of the pressing portions 182*b* and 182*c* at both ends are longer than a distance D1 from the top to the bottom of the pressing portion 182*a* at the middle portion (D2>D1, and D3>D1). In addition, the distance D2 may be equal to the distance D3 (D2=D3).

As described above, the cover member 82 has the three pressing portions 182*a* to 182*c* to press the head holders 51A and 51*a* When the pressing portions 182*b* and 182*c* at both ends in the moving direction of the carriage 5 press the head holders 51A and 51B, the pressing portions 182*b* and 182*c* can displace (deform). Meanwhile, when the pressing portion 182*a* at the middle portion presses the head holders 51A and 51B, the pressing portion 182*a* displaces at an amount smaller than that of each of the pressing portions 182*b* and 182*c*. The pressing portion 182*a* at the middle portion has a degree of stiffness capable of displacing with displacement of the entire cover member 82.

The cover member 82 is, e.g., an elastic molded resin or a metal plate.

As described above, the cover member 82 has at least one displaceable pressing portion, thus reliably pressing the head holders.

Next, a fifth exemplary embodiment of the present disclosure is described with reference to FIG. 18.

Figure 18:
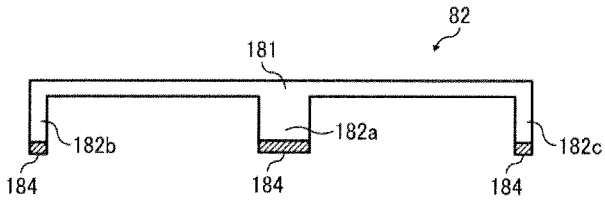
FIG. 18 is a schematic front view of a cover member to press head holders in a fifth exemplary embodiment.

FIG. 18 is a schematic front view of a cover member to press head holders in the fifth exemplary embodiment.

In this exemplary embodiment, elastic members 184 are disposed at portions at which pressing portions 182*a* to 182*c* of the cover member 82 contact head holders 51A and 51B. The elastic members 184 may be, for example, springs, molds, or sponges.

Such a configuration can more reliably press the head holder.

Figure 19:
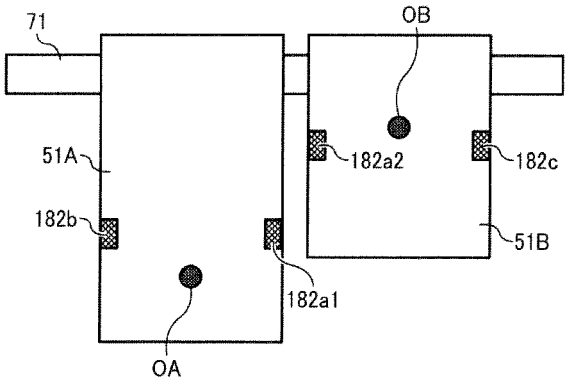
FIG. 19 is a schematic plan view of centroids and pressed points of head holders in a sixth exemplary embodiment The accompanying drawings are intended to depict exemplary embodiments of the present disclosure and should not be interpreted to limit the scope thereof. The accompanying drawings are not to be considered as drawn to scale unless explicitly noted.

Next, a sixth exemplary embodiment of the present disclosure is described with reference to FIG. 19, FIG. 19 shows centroids and pressed points of head holders in the sixth exemplary embodiment.

In this exemplary embodiment, a cover member 82 contacts a head holder 51A at a pressing portion 182*a*1 and a pressing portions 182*b*. Meanwhile, another cover member 82 contacts a head holder 51B at a pressing portion 182*a*2 and a pressing portions 182*c*. In other words, the two cover members 82 are separately provided for the head holders 51A and 51B.

The distance from a centroid OA of the head holder 51A to the reference shaft member 71 differs from the distance from a centroid OB of the head holder 51B to the reference shaft member 71. Hence, based on the distance from the reference shaft member 71 to each of the centroids OA and OB, the distance from the reference shaft member 71 to each of the pressing portion 182*a*1 and the pressing portion 182*b* in the head holder 51A is set to be different from the distance from the reference shaft member 71 to each of the pressing portion 182*a*2 and the pressing portions 182*c* in the head holder 51B.

As a result, differences in weight and pressure between the head holders 51A and 51B are balanced, thus allowing the reference shaft member 71 to receive uniform forces from the head holders 51A and 51B.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a plurality of recording heads having a plurality of nozzles to eject liquid droplets;

a plurality of head holders to hold the plurality of recording heads;

a carriage reciprocally movable in a main scanning direction and holding the plurality of head holders;

a guide member disposed along the main scanning direction to guide the carriage along the main scanning direction;

a reference member disposed parallel to the guide member in the carriage to hold the plurality of head holders; and a pressing member to press at least one of the plurality of head holders toward at least another of the plurality of head holders, wherein each head holder amongst the plurality of head holders has protrusions protruding from respective side faces of the head holder, each protrusion has a reference face, and for adjacent head holders, the reference face of the protrusion from a side face of one of the adjacent head holders contacts the reference face of the protrusion from a side face of the other of the adjacent head holders in the main scanning direction to determine relative positions of the adjacent head holders, and with the plurality of recording heads positioned based on the reference faces of the plurality of head holders, the plurality of recording heads is held by the plurality of head holders.

2. The image forming apparatus of claim 1, wherein the reference faces and a pressing point of the pressing member at which the pressing member presses the at least one of the plurality of head holders are on same line in the main scanning direction.

3. The image forming apparatus of claim 1, further comprising a holder pressing unit to press the plurality of head holders from an upper side of the plurality of head holders.

4. The image forming apparatus of claim 3, wherein the holder pressing unit has a cover member to press the plurality of head holders against the reference member, the cover member has at least three pressing portions to contact the plurality of head holders, when the cover member presses the plurality of head holders, at least one of the at least three pressing portions is displaceable.

5. The image forming apparatus of claim 4, wherein, when the cover member presses the plurality of head holders, at least another one of the at least three pressing portions is displaceable at an amount smaller than the at least one of the at least three pressing portions.

6. The image forming apparatus of claim 4, wherein the cover member has an elastic portion connecting the at least three pressing portions.

7. The image forming apparatus of claim 4, wherein the at least three pressing portions are arranged at different positions in the main scanning direction, a central one of the at least three pressing portions at a central portion of the cover member in the main scanning direction has a smallest displaceable amount of the at least three pressing portions, a distal one of the at least three pressing portions at each end of the cover member in the main scanning direction is displaceable at an amount greater than the central one, and when the cover member does not press the plurality of head holders, the distal one at the each end of the cover member protrudes to a position closer to the plurality of head holders than the central one.

8. The image forming apparatus of claim 4, wherein each of the plurality of head holders differs from at least another one of the plurality of head holders with respect to a distance from the reference member to each of the at least three pressing portions determined based on a distance from the reference member to a centroid of the each of the plurality of head holders.

9. An image forming apparatus comprising:

a plurality of recording heads having a plurality of nozzles to eject liquid droplets;

a plurality of head holders to hold the plurality of recording heads;

a carriage reciprocally movable in a main scanning direction and holding the plurality of head holders;

a guide member disposed along the main scanning direction to guide the carriage along the main scanning direction;

a reference member disposed parallel to the guide member in the carriage to hold the plurality of head holders; and a pressing member to press at least one of the plurality of head holders toward at least another of the plurality of head holders, wherein the plurality of head holders have reference faces to contact each other in the main scanning direction to determine relative positions of the plurality of head holders, and with the plurality of recording heads positioned based on the reference faces of the plurality of head holders, the plurality of recording heads are held by the plurality of head holders, and wherein the reference faces of the plurality of head holders are disposed at a plurality of different positions in a direction perpendicular to the main scanning direction, and with each of the plurality of head holders contacting the reference member at a single point, the plurality of head holders is held by the reference member.

10. An image forming apparatus comprising:

a plurality of recording heads having a plurality of nozzles to eject liquid droplets;

a plurality of head holders to hold the plurality of recording heads;

a carriage reciprocally movable in a main scanning direction and holding the plurality of head holders;

a guide member disposed along the main scanning direction to guide the carriage along the main scanning direction;

a reference member disposed parallel to the guide member in the carriage to hold the plurality of head holders; and a pressing member to press at least one of the plurality of head holders toward at least another of the plurality of head holders, wherein the plurality of head holders have reference faces to contact each other in the main scanning direction to determine relative positions of the plurality of head holders, and with the plurality of recording heads positioned based on the reference faces of the plurality of head holders, the plurality of recording heads are held by the plurality of head holders, wherein the at least one of the plurality of head holders has a slanted face to receive a pressing force of the pressing member.

11. The image forming apparatus of claim 10, wherein the reference faces of the plurality of head holders are slanted relative to a plane perpendicular to the main scanning direction.

12. An image forming apparatus comprising:

a plurality of recording heads having a plurality of nozzles to eject liquid droplets;

a plurality of head holders to hold the plurality of recording heads;

a carriage reciprocally movable in a main scanning direction and holding the plurality of head holders;

a guide member disposed along the main scanning direction to guide the carriage along the main scanning direction;

a reference member disposed parallel to the guide member in the carriage to hold the plurality of head holders;

a pressing member to press at least one of the plurality of head holders toward at least another of the plurality of head holders; and an intermediate member held by the reference member, wherein the plurality of head holders is held by the reference member within the intermediate member, and wherein the plurality of head holders have reference faces to contact each other in the main scanning direction to determine relative positions of the plurality of head holders, and with the plurality of recording heads positioned based on the reference faces of the plurality of head holders, the plurality of r cording heads are held by the plurality of head holders.

* * * * *